US009874418B2

(12) United States Patent
White et al.

(10) Patent No.: US 9,874,418 B2
(45) Date of Patent: Jan. 23, 2018

(54) SOUND SUPPRESSING GUN BARREL

(71) Applicants: Jeff A. White, Maize, KS (US); Kevin Campbell, Maize, KS (US)

(72) Inventors: Jeff A. White, Maize, KS (US); Kevin Campbell, Maize, KS (US)

( * ) Notice: Subject to any disclaimer, the term of this patent is extended or adjusted under 35 U.S.C. 154(b) by 21 days.

(21) Appl. No.: 14/752,041

(22) Filed: Jun. 26, 2015

(65) Prior Publication Data

US 2015/0338184 A1 Nov. 26, 2015

(51) Int. Cl.
*F41A 21/30* (2006.01)

(52) U.S. Cl.
CPC ..... *F41A 21/30* (2013.01)

(58) Field of Classification Search
CPC ..... F41A 21/00; F41A 21/16; F41A 21/18; F41A 21/24; F41A 21/28; F41A 21/30; F41A 21/32; F41A 21/325; F41A 21/34; F41A 21/36; F41A 21/40
USPC .... 89/14.05, 14.1, 14.2, 14.3, 14.4, 14.7, 15
See application file for complete search history.

(56) References Cited

U.S. PATENT DOCUMENTS 1,021,742 A 3/1912 Moore et al.
1,335,444 A * 3/1920 Lashley ..... F41A 21/18 42/78
1,355,422 A * 10/1920 Pedersen ..... F41A 21/12 42/76.01
1,363,058 A * 12/1920 Schneider ..... F41A 21/36 89/14.3
1,427,802 A 9/1922 Goodwin
1,435,084 A * 11/1922 Schneider ..... F41A 21/325 89/14.3
1,770,471 A 7/1930 Hatcher
2,089,219 A * 8/1937 Moore ..... F41A 21/18 42/78
2,375,617 A 5/1945 Bourne
2,848,401 A * 8/1958 Hartley ..... C25F 3/14 204/239
3,483,794 A * 12/1969 Packard ..... F41A 21/12 42/78
3,500,955 A 3/1970 Werbell
3,566,528 A * 3/1971 Musser ..... F41A 21/18 102/439

(Continued)

FOREIGN PATENT DOCUMENTS

GB 2281119 2/1995

*Primary Examiner* — Stephen Johnson
*Assistant Examiner* — Benjamin S Gomberg
(74) *Attorney, Agent, or Firm* — Kenneth H. Jack; Davis & Jack, L.L.C.

(57) ABSTRACT

A gun barrel for guiding a bullet along a longitudinal axis, the bullet having a diameter, the gun barrel having a circumferential series of lands, each land among the circumferential series of lands being radially displaced from the longitudinal axis a distance at least as great as one-half of the bullet's diameter, each land extending helically about the longitudinal axis; a plurality of sound reflection chambers, each sound reflection chambers among the plurality of sound reflection chambers being positioned between an adjacent pair of lands among the circumferential series of lands, each sound reflection chamber having a muzzle end, and each sound reflection chamber opening radially inwardly; and a plurality of sound reflection walls, each wall among the plurality of sound reflection walls closing one of the sound reflection chambers' muzzle ends.

9 Claims, 5 Drawing Sheets

(56) References Cited

U.S. PATENT DOCUMENTS

| | | | | | |
|---|---|---|---|---|---|
| 3,667,570 | A | | 6/1972 | WerBell, III | |
| 3,895,752 | A | | 7/1975 | Hatayama et al. | |
| 4,322,999 | A | * | 4/1982 | Aston | F41A 21/36 89/14.3 |
| H000278 | H | * | 6/1987 | Steiner | F21A 21/32 42/77 |
| 4,685,534 | A | | 8/1987 | Burstein et al. | |
| 5,773,746 | A | | 6/1998 | Vaden | |
| 5,844,162 | A | * | 12/1998 | Renner | F41A 21/18 42/51 |
| 6,308,609 | B1 | | 10/2001 | Davies | |
| 6,427,373 | B1 | * | 8/2002 | Schuemann | F41A 21/18 42/78 |
| 7,676,976 | B2 | | 3/2010 | Dueck et al. | |
| 7,832,323 | B1 | | 11/2010 | Davies | |
| 8,104,394 | B2 | | 1/2012 | Meyers | |
| 8,292,025 | B1 | | 10/2012 | Woodell et al. | |
| 8,307,946 | B1 | | 11/2012 | Johnston | |
| 8,418,803 | B2 | | 4/2013 | Findlay | |
| 8,424,441 | B2 | | 4/2013 | Brittingham et al. | |
| 8,424,635 | B1 | | 4/2013 | Klawunn | |
| 8,464,625 | B2 | * | 6/2013 | Polovnev | F41A 21/34 89/14.2 |
| 8,479,632 | B2 | | 7/2013 | Kline et al. | |
| 8,959,821 | B1 | * | 2/2015 | Calvert | F41A 21/18 42/76.01 |
| 2012/0152093 | A1 | | 6/2012 | Koumbis | |
| 2012/0291614 | A1 | | 11/2012 | Koumbis | |
| 2013/0168181 | A1 | | 7/2013 | Wirth et al. | |

* cited by examiner

SOUND SUPPRESSING GUN BARREL

FIELD OF THE INVENTION

This invention relates to firearms and gun barrels for firearms. More particularly, this invention relates to specialized gun barrel adaptations and auxiliary gun silencers for suppressing gun fire noise.

BACKGROUND OF THE INVENTION

Commonly known and conventionally configured gun barrels or silencer auxiliary components which are adapted for bullet propulsion blast noise suppression include an interior series of baffles or vanes which terminate radially inwardly to form a bullet passage channel. Such interior vanes form and define series of sound reflection chambers arranged at and about the gun barrel's muzzle end. The sonic shock wave produced when the gun fires is directed and redirected within the reflection chambers, ultimately diminishing the intensity of the shock wave emitting from the gun's muzzle.

While conventional and known gun silencer vane and reflection chamber configurations effectively reduce noise, such configurations often undesirably create internal compressed gas vortices and currents which tend to degrade and suppress the bullet's rifling induced spin about its longitudinal axis. By allowing or promoting such bullet spin degradation, conventional gun silencers tend to degrade the ballistic performance of fired bullets.

The instant inventive gun barrel solves or ameliorates such problems and defects of conventionally configured gun muzzle silencers by specially configuring a circumferential array of silencing vanes and chambers within a gun barrel or barrel configured auxiliary silencer for complimenting and reinforcing the bullet's rifling induced spin while effectively damping sound.

BRIEF SUMMARY OF THE INVENTION

A first structural component of the instant inventive gun barrel comprises a circumferential series of lands, each land among the circumferential series of lands being displaced radially from the gun barrel's central longitudinal axis a distance at least as great as one-half of the diameter of bullets which may travel through the gun barrel. In a preferred embodiment, the lands are arrayed intermittently about the longitudinal axis, and each land extends both longitudinally along and helically about the gun barrel's longitudinal axis. In a preferred embodiment, the gun barrel has breachward rifling, and each land preferably has a helical pitch matching the pitch of such breachward rifling.

A further structural component of the instant inventive gun barrel comprises a plurality of sound reflection chambers, each sound reflection chamber among the plurality of sound reflection chambers being positioned between an adjacent pair of lands among the circumferential series of lands. Each sound reflection chamber has a breachward end and a muzzle end, and each such chamber preferably opens radially inwardly to communicate with an axial bullet passage channel or bore. The radial height of each of the sound reflection chambers is preferably at least as great as one-half of the diameter or caliber of bullets which are fitted to the gun barrel.

Further structural components of the instant inventive gun barrel comprise a plurality of sound reflection walls, each wall among the plurality of sound reflection walls, preferably closing one of the sound reflection chambers' muzzle ends.

In operation of the instant inventive gun barrel, the helical paths or extensions of the circumferential series of lands, along with the corresponding helical extensions of the sound reflection chambers spaced between the lands, advantageously coordinates such chambers' sound damping and suppressing effect with a bullet's rifling induced spin. Vortices and currents of compressed gasses driven by a bullet into the helically extending sound reflection chambers are directed by such chambers so that they compliment rather than interfere with the spin of the bullet. The helically directed gasses enhance the ballistic performance of the bullet. The helical lands which radially overlie the bullet as it passes beneath the helical sound reflection chambers further compliment and reinforce the bullet's spin. The bullet spin coordinating and reinforcing functions of the instant inventive gun barrel are advantageously performed simultaneously with its sound suppressing function.

Accordingly, objects of the instant invention include the provision of a gun barrel for firing and guiding a bullet projectile along a longitudinal axis which incorporates structures, as described above, and which arranges those structures in relation to each other in manners described above, for the achievement of the benefits and advantages described above.

Other and further objects, benefits, and advantages of the instant invention will become known to those skilled in the art upon review of the Detailed Description which follows, and upon review of the appended drawings.

DETAILED DESCRIPTION OF PREFERRED EMBODIMENTS

Figures 1, 2:
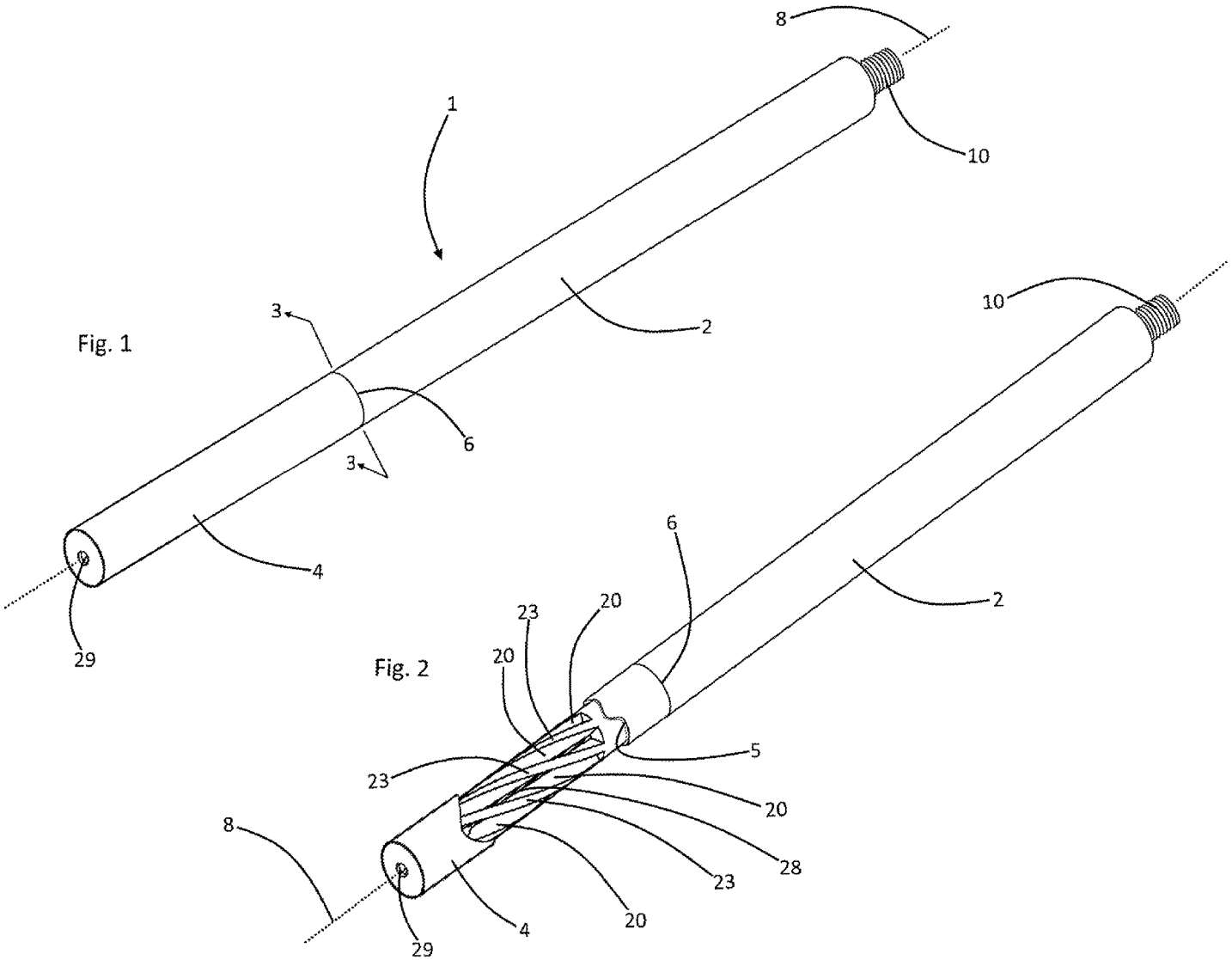
FIG. 1 is a perspective view of a preferred embodiment of the instant inventive gun barrel.
FIG. 2 redepicts the structure of FIG. 1, the view of FIG. 2 showing a cylindrical outer gun barrel layer "cutaway" for explanation of underlying structures.
Figure 3:
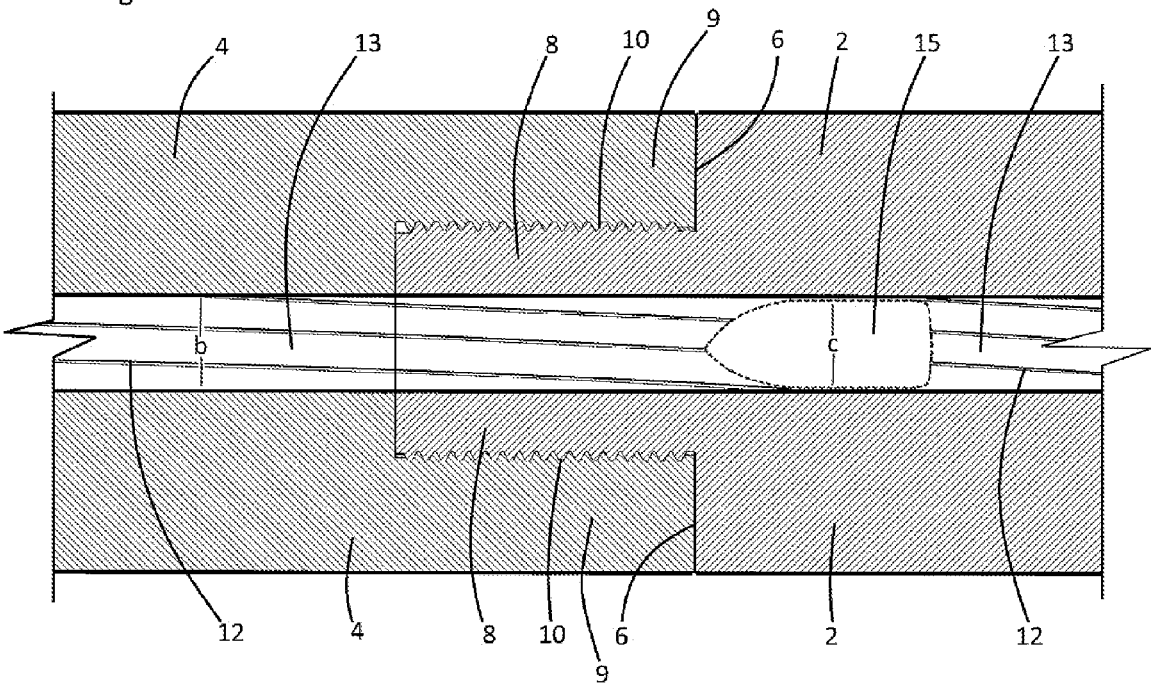
FIG. 3 is a partial sectional view as indicated in FIG. 1.

Referring now to the drawings and in particular to Drawing FIG. 1, a preferred embodiment of the instant inventive gun barrel is referred to generally by Reference Arrow 1. The gun barrel 1 has a breach segment or portion 2 and a muzzle segment or portion 4, said segments being fixedly interconnected by attaching means. Referring further simultaneously to FIG. 3, the attaching means component of the instant invention may comprise a joint 6, which may suitably comprise nesting barrel fastener sections 8 and 9 which are releasably interconnected by helical threads 10. Where the invention's fastening means are configured as a helically threaded joint as indicated in FIG. 3, the muzzle segment 4 of the inventive gun barrel may be easily and conveniently attached and detached in the manner of a rifle or handgun's auxiliary silencer component. Where the instant invention is configured as such auxiliary attachable and detachable silencer, as a separate component and to the exclusion of provision of any breachward barrel segment, such silencer itself is considered to constitute the instant inventive gun barrel.

Figure 3A:
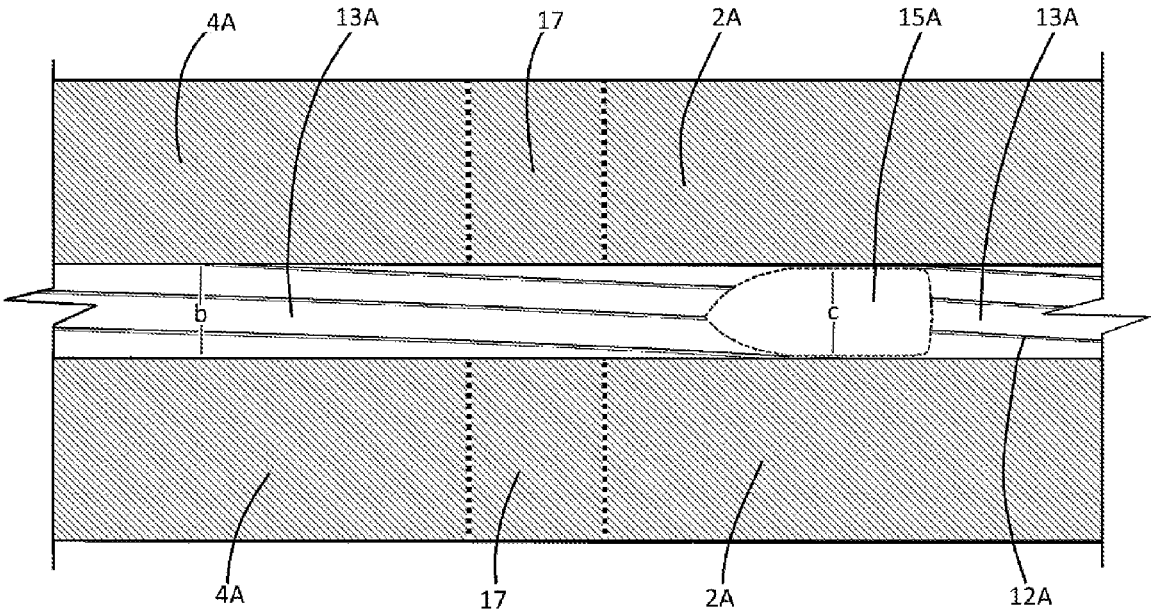
FIG. 3A is an alternate configuration of the structure depicted in FIG. 3.

Referring simultaneously to FIGS. 1, 3, and 3A, each structure identified in FIG. 3A by a reference numeral having the suffix "A" is configured substantially identically with similarly numbered structures appearing in FIGS. 1 and 3. In the FIG. 3A structural alternative, the means for attaching and fixedly interconnecting the gun barrel's breach and muzzle segments 2A and 4A suitably alternatively comprise a wholly formed rigid joint 17 which is denoted by dashed lines. Whole formation of the components of the instant invention including wholly formed joint 17 may be achieved by 3-D metal printing processes, metal casting processes, or metal milling processes.

Referring to FIGS. 1-3, the breachward segment 2 of the gun barrel 1 has a hollow bore 13, such bore having diameter or caliber "b". The bore 13 extends along a central longitudinal axis 8, and the bore 13 may muzzlewardly convey a bullet projectile 15 having a caliber or diameter "c" which is substantially equivalent with diameter "b". The bullet projectile 15 is intended as being representative of all types of tube accelerated projectiles. Helical rifling 12 milled into the cylindrical wall of bore 13 imparts spin to the bullet 15 about its longitudinal axis for purposes of directional stability of the bullet during flight.

Figure 4:
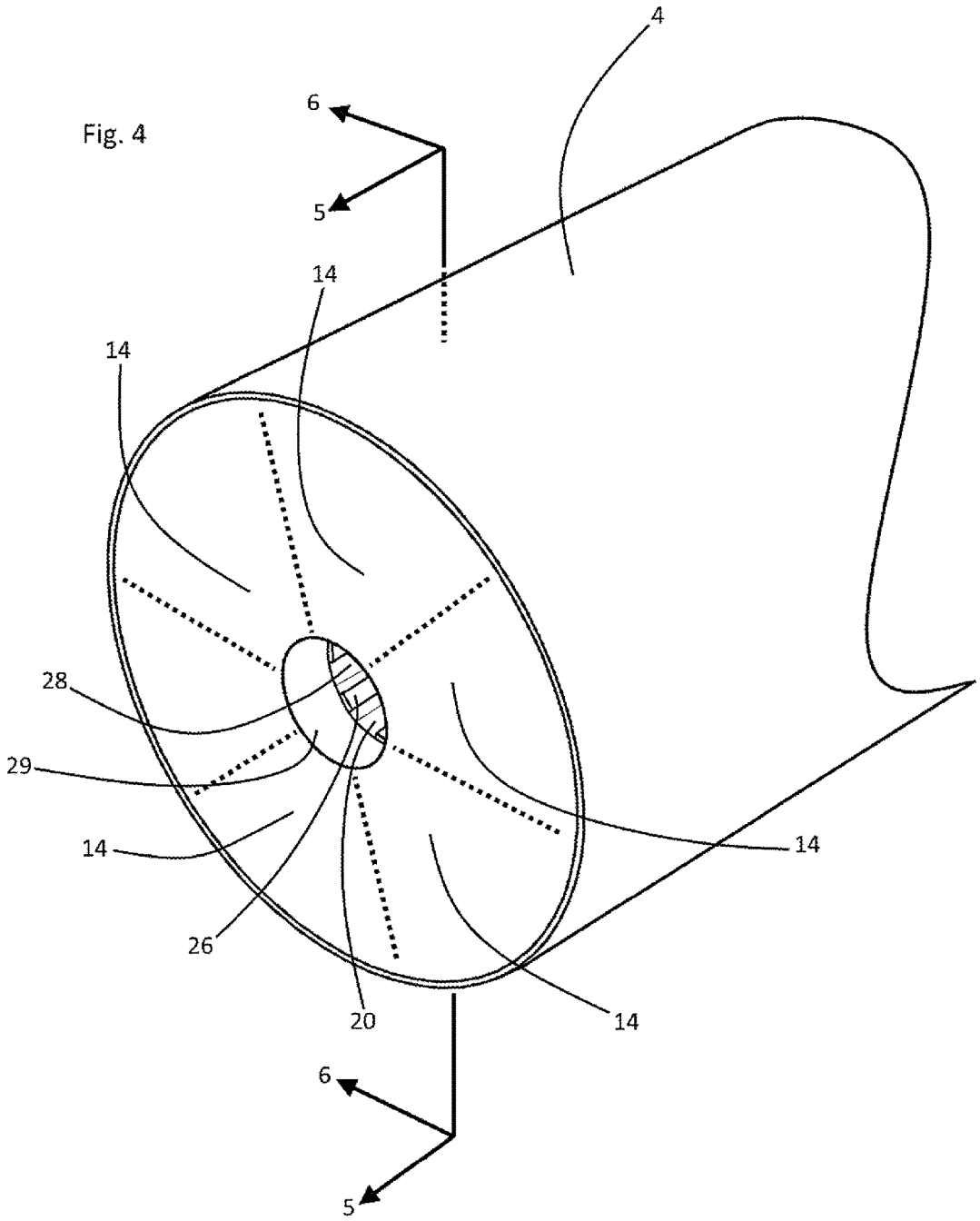
FIG. 4 is a magnified view of a muzzle portion of the structure depicted in FIG. 1.
Figure 5:
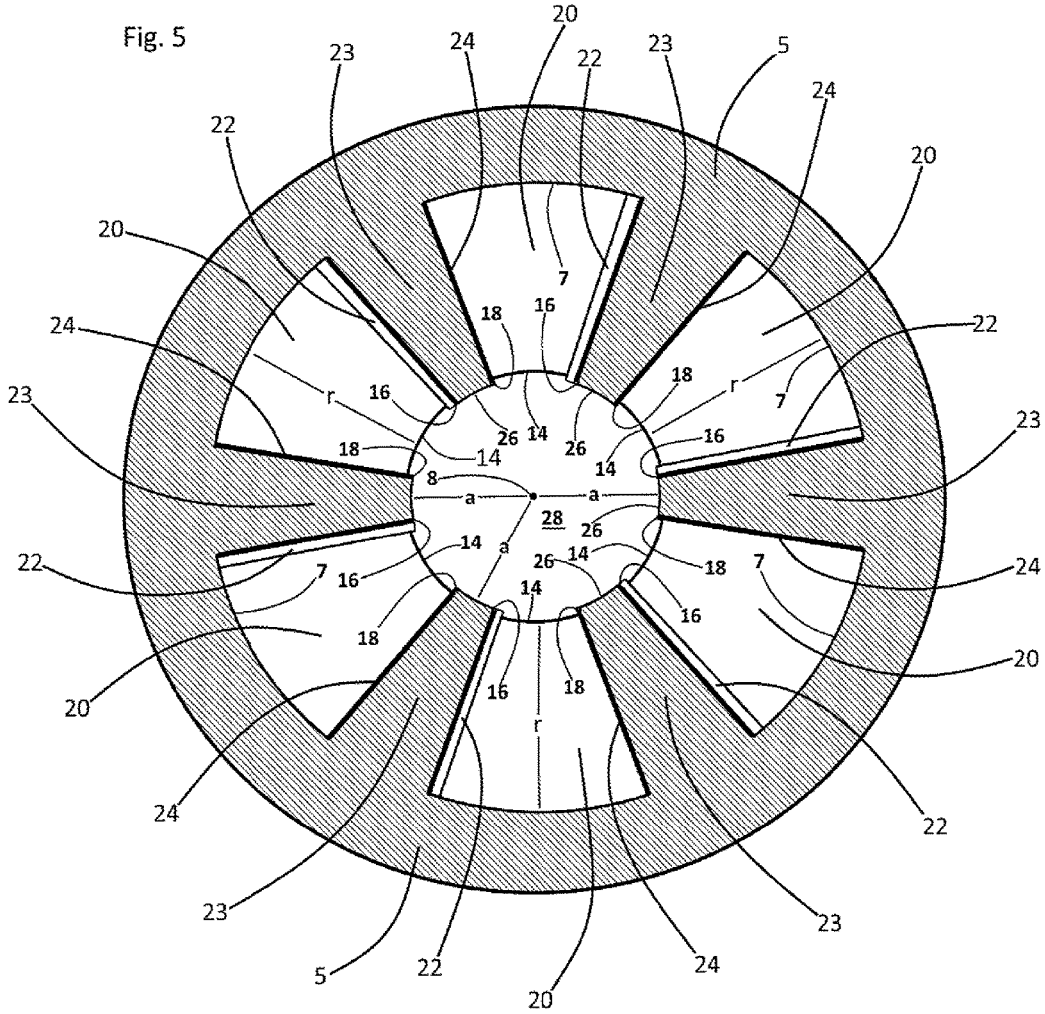
FIG. 5 is a sectional view as indicated in FIG. 4.

Referring simultaneously to FIGS. 3-5, bore 13 is longitudinally continuous with and communicates with a muzzle segment bore 28 through which bullet 15 may pass. An intermittent and circumferentially arrayed series of lands 26 surrounds the bore 28 and surrounds the gun barrel's longitudinal axis 8 extends centrally therethrough. In the preferred embodiment of the instant invention, each land among the circumferential series of lands 26 is displaced radially away from the longitudinal axis 8 a distance "a", such distance being at least as great as one-half of the diameter "b" of bore 13. While the radial land displacement "a" may suitably be substantially identical to one-half of the diameter "b", such displacement may be slightly greater (preferably between 1/1000" and 1/500") in order to accommodate for fired bullets' tendency to radially rebound from obturating pressure experienced during acceleration within bore 13.

Referring simultaneously to FIGS. 2, 3, and 5, each land among the circumferential series of lands 26 has a circumferential end 18 and an oppositely circumferential end 16, and each land preferably being slightly concave in order to match the circular outer periphery of bullet 15. The lands 26 preferably extend helically about longitudinal axis 8 and, for consistency in spin effect exerted against the bullet 15, the helical pitch of the lands 26 preferably substantially matches that of the rifling 12.

Figure 6:
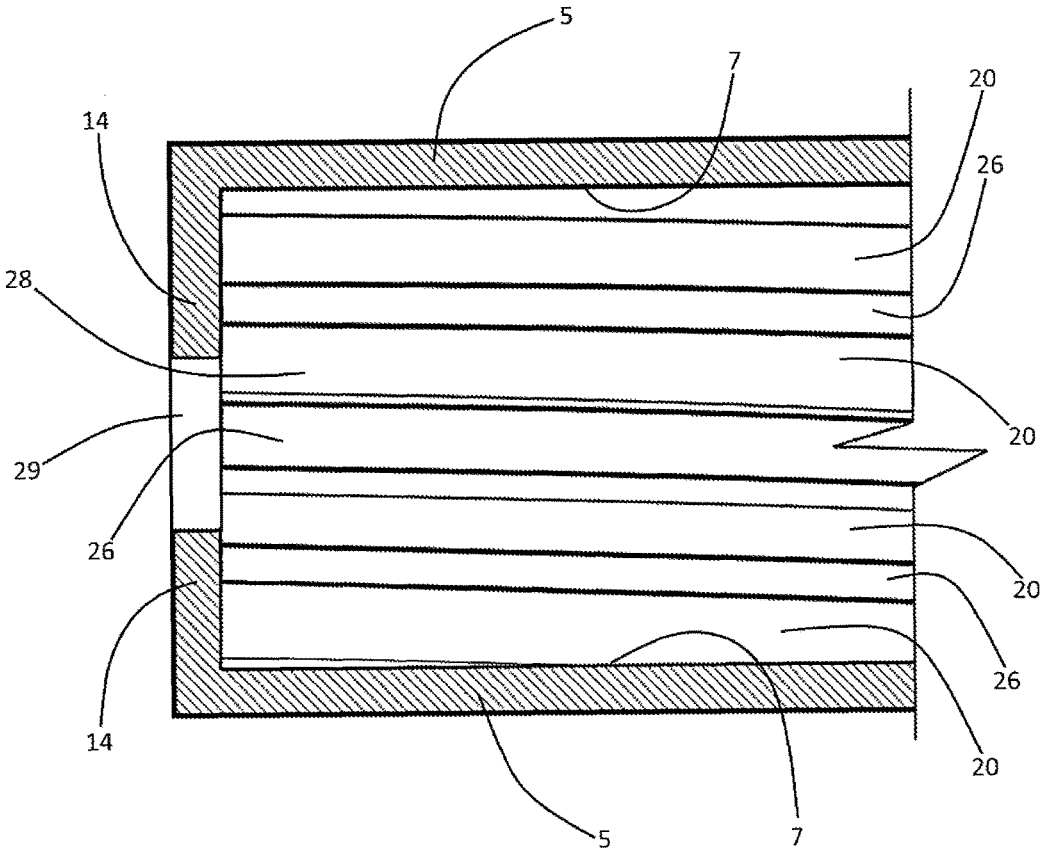
FIG. 6 is an alternative sectional view as indicated in FIG. 4.

Referring simultaneously to FIGS. 5 and 6, a plurality of sound reflection chambers 20 circumferentially surrounds the longitudinal axis 8 and the bore 28, each such chamber 20 opening radially inwardly toward and communicating with bore 28. Each sound reflection chamber 20 has a helically extending circumferential wall 22 which extends radially outwardly from one of the lands' oppositely circumferential ends 16, and has a helically extending oppositely circumferential wall 24 which similarly extends radially outwardly from one of the lands' circumferential ends 18. The sound reflection chambers 20 reside between adjacent lands 26, and their circumferential and oppositely circumferential walls 24 and 22 are preferably formed and defined by a circumferential series of helically extending vanes 23. The proximal or radially outer ends of the vanes 23 are preferably fixedly attached to or are wholly formed with a cylindrical outer wall 5, and the distal or radially inner ends of vanes 23 define and support the circumferential series of lands 26. The inwardly exposed radially inner surfaces of the cylindrical wall 5 advantageously forms a plurality of chamber ceilings 7, each of which radially outwardly closes and covers one of the sound reflection chambers 20. Like the vanes 23, the chamber ceilings 7 extend longitudinally and helically, following the helical pitch of lands 26.

In order for the sound reflection chambers 20 to effectively dampen and suppress sound waves, each chamber 20 preferably has a radial height "r" which is at least as great as one-half of the bore diameter "b".

Referring simultaneously to FIGS. 4-6, a plurality of sound reflection walls 14 preferably covers and closes the muzzleward ends of the sound reflection chambers 20. The radially inner ends of the sound reflection walls 14 preferably form a muzzle port 29 whose diameter may, for the purposes of prevention of mechanical interference with emitting bullets, be slightly greater (preferably between 1/1000" and 1/500") than that of bullet 15.

In operation of the instant inventive gun barrel, and upon firing of bullet 15, compressed air driven muzzlewardly by the bullet along bore 13 spills radially outwardly toward and expands into the sound reflection chambers 20. As a result of the helical extensions of the sound reflection chambers 20 (along with their helically extending walls 22 and 24, and helically extending ceilings 7), currents and vortices of compressed gasses driven into such chambers advantageously travel helically in a manner which compliments, rather than interferes with the rifling induced spin of bullet 15. The instant invention's bullet spin complimenting function continues to be performed as the bullet traverses bore 28 under the effect of the immediately overlying circumferential series of lands 26. While the bullet 15 passes through bore 28, the close proximity of the helically extending lands 26 further compliments and reinforces the spin of the bullet. Accordingly, the instant inventive gun barrel effectively performs a gun blast silencing function while complimenting and reinforcing the bullet's rifling induced spin. Such dual functions ameliorate the tendency of conventional gun silencers to degrade bullet spin and degrade the bullets' ballistic performance.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. A gun barrel for guiding a bullet along a longitudinal axis, the bullet having a diameter, the gun barrel comprising:

(a) a circumferential series of lands, each land among the circumferential series of lands being radially displaced from the longitudinal axis a distance at least as great as one-half of the bullet's diameter, said each land extending helically about the longitudinal axis;

(b) a plurality of sound reflection chambers, each sound reflection chamber among the plurality of sound reflection chambers being positioned between an adjacent pair of lands among the circumferential series of lands, said each chamber opening radially inwardly and having a muzzle end;

(c) a plurality of ceilings, each ceiling having a muzzle end, said each ceiling overlying one of the sound reflection chambers; and (d) a plurality of sound reflection walls having radially outer ends, each wall among the plurality of sound reflection walls closing one of the sound reflection chambers' muzzle ends, the radially outer end of said each wall being fixedly attached to the muzzle end of one of the ceilings, wherein each said sound reflection wall is configured to block sound waves from exiting through the muzzle ends of each of the sound reflection chambers.

2. The gun barrel of claim 1 wherein each sound reflection chamber has a radial height at least as great as one-half of the bullet's diameter.

3. The gun barrel of claim 2 wherein each land among the circumferential series of lands has circumferential and oppositely circumferential ends, wherein each sound reflection chamber among the plurality of sound reflection chambers has circumferential and oppositely circumferential walls, wherein each wall among the sound reflection chambers' circumferential walls extends radially from one of the lands' oppositely circumferential ends, and wherein each wall among the sound reflection chambers' oppositely circumferential walls extends radially from one of the lands' circumferential ends.

4. The gun barrel of claim 3 wherein each wall among the sound reflection chambers' circumferential and oppositely circumferential walls extends helically about the longitudinal axis.

5. The gun barrel of claim 4 wherein each land among the circumferential series of lands has a helical pitch, and further comprising rifling extending along the longitudinal axis, the rifling having a helical pitch, said each land's helical pitch being substantially equal to the rifling's helical pitch.

6. The gun barrel of claim 5 wherein each land among the circumferential series of lands is concave.

7. The gun barrel of claim 5 further comprising muzzle and breach segments, the circumferential series of lands and the plurality of sound reflection chambers being positioned at the muzzle segment and the rifling being positioned at the breach segment.

8. The gun barrel of claim 7 further comprising means for fixedly interconnecting the muzzle and breach segments.

9. The gun barrel of claim 8 wherein the fixed interconnecting means comprise a joint selected from the group consisting of helically threaded joints and wholly formed joints.

* * * * *